US007073283B2

(12) United States Patent
Watley

(10) Patent No.: US 7,073,283 B2
(45) Date of Patent: Jul. 11, 2006

(54) BREECH PLUG FOR MUZZLELOADING FIREARMS

(75) Inventor: Bruce E Watley, Centerville, IA (US)

(73) Assignee: Bug-Out Outdoorwear, Inc., Centerville, IA (US)

( * ) Notice: Subject to any disclaimer, the term of this patent is extended or adjusted under 35 U.S.C. 154(b) by 96 days.

(21) Appl. No.: 10/912,807

(22) Filed: Aug. 6, 2004

(65) Prior Publication Data

US 2006/0026881 A1 Feb. 9, 2006

(51) Int. Cl.
*F41A 19/57* (2006.01)

(52) U.S. Cl. ..... 42/51; 89/27.13

(58) Field of Classification Search ..... 42/51, 42/25; 89/1.3, 27.13
See application file for complete search history.

(56) References Cited

U.S. PATENT DOCUMENTS

| | | | | |
|---|---|---|---|---|
| 2,465,553 | A * | 3/1949 | Robinson, Jr. | 42/25 |
| 2,603,019 | A * | 7/1952 | Elkas | 42/25 |
| 2,603,020 | A * | 7/1952 | Hussey | 42/25 |
| 4,135,321 | A * | 1/1979 | Lewallyn | 42/83 |
| 5,644,861 | A | 7/1997 | Knight | |
| 6,216,380 | B1 | 4/2001 | McGarity, Jr. et al. | |
| 6,343,430 | B1 * | 2/2002 | Martel | 42/83 |

* cited by examiner

*Primary Examiner*—Stephen M. Johnson

(57) ABSTRACT

A breech plug having a body with first and second ends and a compression chamber extending therethrough, a primer holder mounted to the first end of the body having a central aperture aligned with the compression chamber with slots extending radially from the central aperture and terminating in an annular groove, and a retaining spring secured to the annular groove.

3 Claims, 2 Drawing Sheets

BREECH PLUG FOR MUZZLELOADING FIREARMS

BACKGROUND OF THE INVENTION

The present invention relates generally to a breech plug and more particularly to a breech plug with an improved primer holder.

Breech plugs are well known in the art for use with muzzleloading firearms. Generally, breech plugs are threadably received within the breech end of the barrel of a rifle and have a nipple for receiving a percussion element. When struck, the explosive material within the percussion element is compressed between the shell of the percussion element and the nipple, igniting a primary flash that is directed through the breech plug to a flash hole where the primary flash ignites a powder charge or propellant.

Much effort has been directed to improving the ignition of muzzleloading firearms. One way in which this has been accomplished is through the use of rifle primers in place of percussion elements. A rifle primer is similar in size and shape to a percussion cap, but contains significantly more priming compound. The rifle primer also has an integral anvil, eliminating the need for a nipple. When the hammer strikes the rifle primer, the priming compound is compressed between the hammer and the integral anvil, setting off the priming compound. Rifle primers often ignite more consistently and thoroughly than percussion elements.

U.S. Pat. No. 6,216,380 to McGarity, Jr. et al. ("McGarity") discloses a breech plug for use with rifle primers. The breech plug, which is threadably received within the firearm barrel, has a primer holder for receiving the primer. A spring-loaded clip is used to retain the primer within the primer holder. The disadvantage with McGarity is that the spring-loaded clip places unnecessary axial loads on the primer, shifting it slightly from the center of the primer holder and potentially resulting in inconsistent ignition. Additionally, the McGarity breech plug has a smooth circular exterior that does not provide for easy insertion of the breech plug into the firearm barrel. Accordingly, there is a need in the art for an improved breech plug.

It is therefore a primary object of the present invention to provide an improved breech plug.

Another object of the present invention is to provide a breech plug that can properly retain a rifle primer to ensure efficient ignition.

Still another object of the present invention is to provide a breech plug that allows for quick and easy insertion into the barrel of a muzzleloading rifle.

These and other objects will be apparent to those skilled in the art.

BRIEF SUMMARY OF THE INVENTION

The present invention is directed towards a breech plug preferably for a muzzleloading firearm having a body with first and second ends and a compression chamber extending therethrough. A primer holder is mounted to the first end of the body having a central aperture aligned with the compression chamber with slots extending radially from the central aperture and terminating in an annular groove. A retaining spring is secured to the annular groove for retaining the primer within the primer holder.

DESCRIPTION OF THE PREFERRED EMBODIMENTS OF THE INVENTION

The present invention is described in reference to a muzzleloading firearm by example only. It is contemplated that the improved breech plug also can be used in other firearms.

Figure 1:
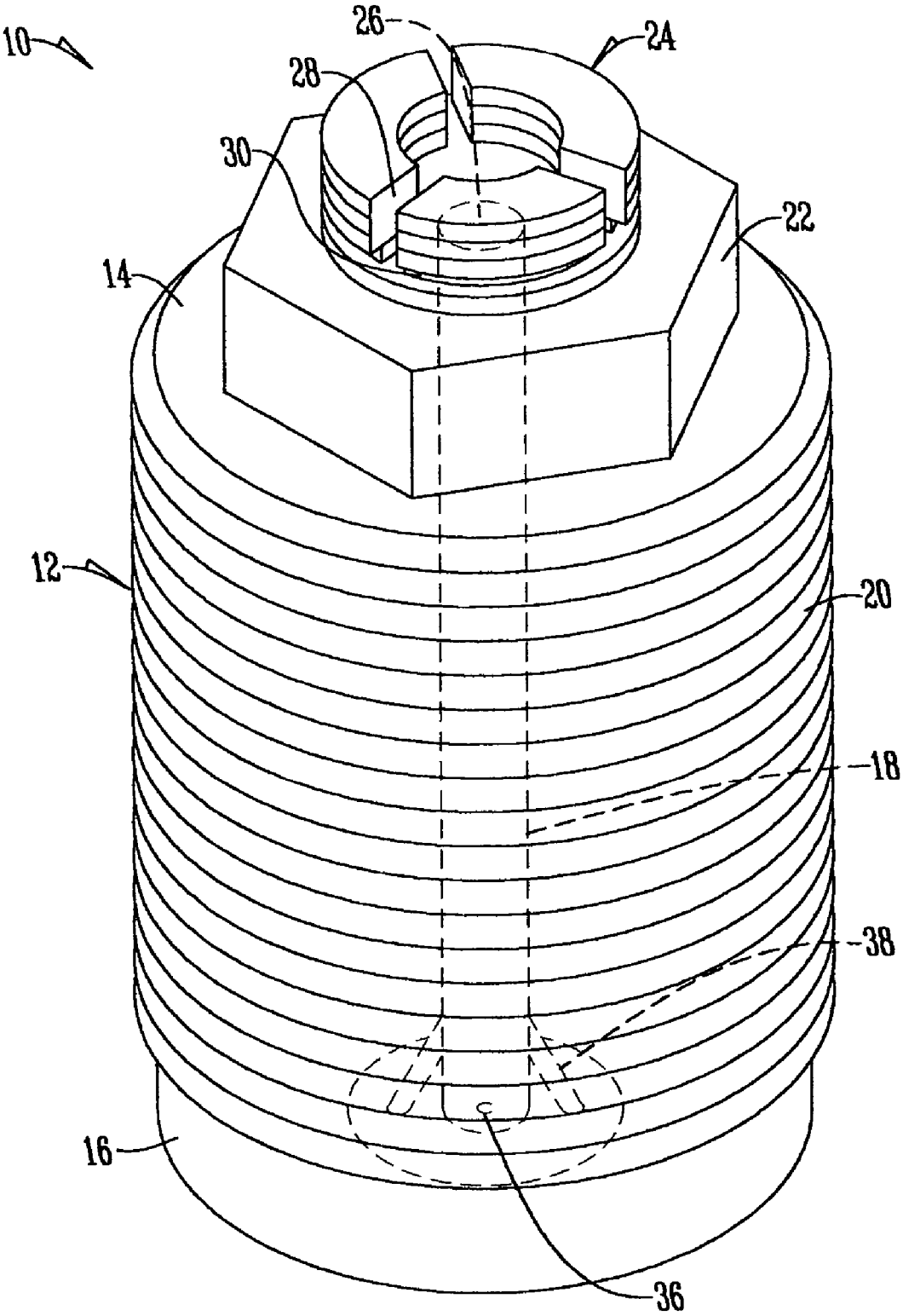
FIG. 1 is a perspective view of the present invention.

With reference to FIG. 1, a breech plug 10 is disclosed having a body 12 with a first end 14 and a second end 16. A compression chamber 18 extends axially through the body 12 between ends 14 and 16. The exterior of the body 12 has threads 20 for engagement with the firearm barrel (not shown). First end 14 terminates in a hexagonally shaped portion 22, as described hereafter.

A primer holder 24 is mounted to the first end 14 of the body 12. The primer holder 24 has a central aperture 26 for retaining a rifle primer 27. The central aperture 26 is aligned and in communication with the compression chamber 18. A plurality of slots 28 extend radially from the center of the central aperture 26 and terminate in an annular groove 30, which circumscribes the primer holder 24.

Figure 2:
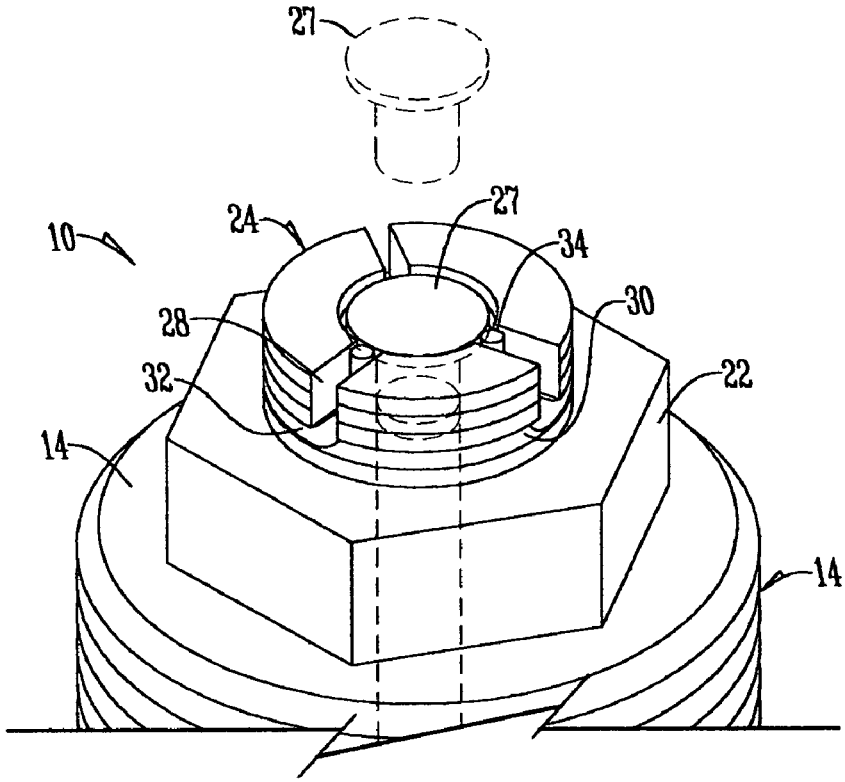
FIG. 2 is a perspective view of the primer holder of the present invention.
Figure 3:
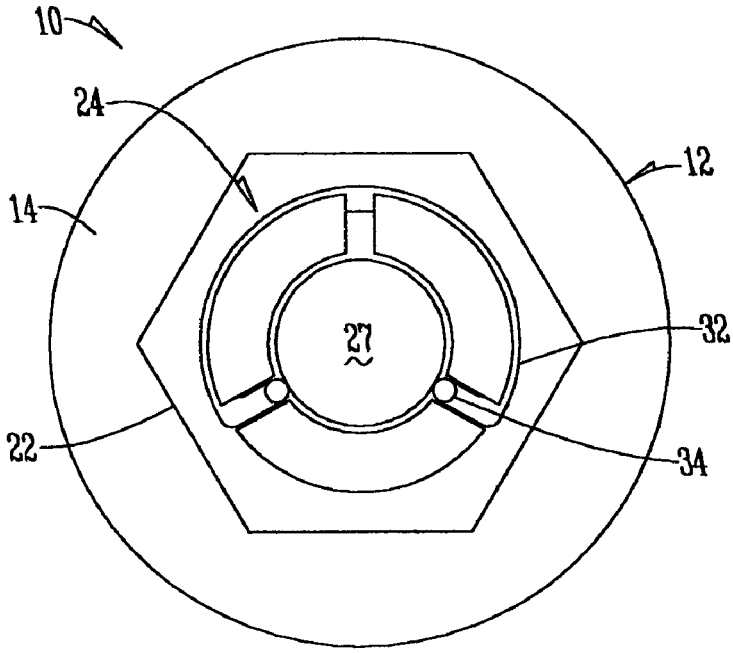
FIG. 3 is a top plan view of the present invention.

A retaining spring 32 fits within the annular groove 30, as shown in FIG. 2. The retaining spring 32 has retaining prongs 34 that extend through the slots 28 and into the central aperture 26 of the primer holder 24 to retain the primer 27 within the central aperture 26.

A flash hole 36 is centrally located on end 16 of body 12 and is aligned and in communication with the compression chamber 18. Additionally, vent holes 38 extend from end 16 of the body 12 into the compression chamber 18. The vent holes 38 are disposed at an angle with respect to the compression chamber 18, preferably forming a forty-five degree angle therewith.

In operation, the breech plug 10 is threadably inserted into the firearm barrel via threads 20 on body 12. The hexagonal portion 22 facilitates insertion of the breech plug 10 into the firearm barrel by allowing the operator to grip the breech plug 10 with ease. A primer 27 is manually inserted into the central aperture 26 of the primer holder 24. The retaining spring 32 is affixed to the primer holder 24 such that the retaining prongs 34 extend through the slots 28 and into the central aperture 26 of the primer holder 24 to secure the primer 27. Thereafter, the firearm hammer is free to strike the primer 27, sending a charge through the compression chamber 18 and out the flash hole 36 to ignite the gun powder and discharge the firearm. Exhaust gases from the primer 27 are allowed to vent the compression chamber 18 via the vent holes 38.

It is therefore seen that through the use of an annular groove and a retaining spring, the present invention permits the efficient ignition of a rifle primer in a muzzleloading firearm.

What is claimed is:

1. A breech plug for receiving a rifle primer, said breech plug comprising:

a body having first and second ends, a compression chamber extending therethrough and a threaded exterior;

a primer holder mounted to the first end of the body having a central aperture aligned with the compression chamber with slots extending radially from the central aperture and terminating in an annular groove; and a retaining spring secured to the annular groove wherein the retaining spring has retaining prongs extending through the slots and into the central aperture of the primer holder adapted for retaining the rifle primer within the central aperture.

2. The device of claim 1 wherein the first end of the body is hexagonal in shape.

3. The device of claim 1 wherein a vent hole is disposed within the body near the second end and is positioned at an angle with respect to the compression chamber.

* * * * *